US010400490B2

(12) United States Patent
Jung

(10) Patent No.: US 10,400,490 B2
(45) Date of Patent: Sep. 3, 2019

(54) REFRIGERATOR

(71) Applicant: Samsung Electronics Co., Ltd., Suwon-si, Gyeonggi-do (KR)

(72) Inventor: Moon Gyo Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/815,115

(22) Filed: Nov. 16, 2017

(65) Prior Publication Data

US 2018/0148962 A1 May 31, 2018

(30) Foreign Application Priority Data

Nov. 30, 2016 (KR) ..... 10-2016-0161992

(51) Int. Cl.
*E05D 7/00* (2006.01)
*E05D 11/06* (2006.01)
*F25D 23/02* (2006.01)

(52) U.S. Cl.
CPC ..... *E05D 7/0027* (2013.01); *E05D 11/06* (2013.01); *F25D 23/028* (2013.01); *F25D 2323/024* (2013.01)

(58) Field of Classification Search
CPC ..... F25D 2323/024; F25D 23/028; E05D 7/0027; E05D 11/06; Y10T 16/544; Y10T 16/5445; Y10T 16/5448
See application file for complete search history.

(56) References Cited

U.S. PATENT DOCUMENTS 5,040,857 A * 8/1991 Mandel ..... E05D 3/022 16/364
5,297,360 A * 3/1994 Besore ..... F25D 23/087 49/478.1
5,458,412 A * 10/1995 Lee ..... E05D 3/022 312/309

(Continued)

FOREIGN PATENT DOCUMENTS

DE 10154934 A1 * 5/2003 ..... F25D 23/087
DE 102005002151 A1 * 7/2006 ..... F25D 21/04

(Continued)

OTHER PUBLICATIONS

Communication from a foreign patent office in a counterpart foreign application, European Patent Office, "European Search Report," Application No. EP 17203625, dated Apr. 10, 2018, 8 pages.

(Continued)

*Primary Examiner* — Andrew M Roersma

(57) ABSTRACT

A refrigerator including a hinge assembly that enables a door to selectively slide and pivot. A refrigerator includes a main body, a storeroom arranged inside the main body. The refrigerator includes a door configured to open and close the storeroom, and a hinge assembly configured to support the door to be able to slide and pivot. The hinge assembly includes a hinge body combined with the door and configured to move back and forth in a front-back direction. The hinge assembly includes a first stopper configured to prevent pivoting of the door if the door is able to slide. The hinge assembly includes a second stopper configured to prevent sliding of the door if the door is able to pivot.

19 Claims, 12 Drawing Sheets

(56) References Cited

U.S. PATENT DOCUMENTS

| | | | | |
|---|---|---|---|---|
| 7,748,080 | B2 * | 7/2010 | Hottmann | E05F 1/1253 16/286 |
| 2006/0244351 | A1 * | 11/2006 | Moon | F25D 23/028 312/405 |

FOREIGN PATENT DOCUMENTS

| | | | |
|---|---|---|---|
| JP | 2003-004115 | A | 1/2003 |
| JP | 2004-191039 | A | 7/2004 |
| KR | 10-2008-0094353 | A | 10/2008 |
| KR | 10-2013-0119274 | A | 10/2013 |
| WO | 2011/132974 | A2 | 10/2011 |

OTHER PUBLICATIONS

Communication under Rule 71(3) EPC dated Sep. 7, 2018 in connection with European Patent Application No. 17 203 625.3, 34 pages.

* cited by examiner

REFRIGERATOR

CROSS-REFERENCE TO RELATED APPLICATION AND CLAIM OF PRIORITY

This application is related to and claims priority to Korean Patent Application No. 10-2016-0161992 filed on Nov. 30, 2016, the contents of which are incorporated herein by reference.

TECHNICAL FIELD

The present disclosure relates to a refrigerator including a door able to selectively slide and pivot.

BACKGROUND

Refrigerators are home appliances having a storeroom for storing groceries and a cool-air supply for supplying cool air into the storeroom, thereby keeping the groceries fresh.

The refrigerator includes a door to open/close the storeroom, and there is a gasket arranged ors the rear side of the door to make the storeroom airtight.

The gasket is typically exposed to the outside of the refrigerator, and the exposed gasket would be discolored and cracked from hardening in time, thereby deteriorating the exterior quality of the product.

SUMMARY

To address the above-discussed deficiencies, it is a primary object to provide a refrigerator including a hinge assembly that enables a door to selectively slide and pivot.

Another aspect of the present disclosure provides a refrigerator including a door configured to pivot after being drawn out forward, in order to avoid a collision with furniture located on a side to the refrigerator.

Another aspect of the present disclosure provides a refrigerator with a gasket that is not exposed to the outside, thereby improving aesthetic values.

In accordance with one aspect of the present disclosure, a refrigerator includes a main body, a storeroom arranged inside the main body, a door configured to open and close the storeroom and a hinge assembly configured to support the door to be able to slide and pivot, wherein the hinge assembly includes a hinge body combined with the door and configured to move back and forth in a front-back direction, a first stopper configured to prevent pivoting of the door if the door is able to slide, and a second stopper configured to prevent sliding of the door if the door is able to pivot.

The door may be configured to open the storeroom by sliding out forward from the storeroom and then pivoting in a direction to open the storeroom, and to close the storeroom by pivoting in a direction to close the storeroom and then sliding into the storeroom.

The door may include a hinge combiner configured to be combined with the hinge body, and the hinge combiner comprises a cut formed by cutting a portion of the hinge combiner.

The first stopper may be configured to prevent pivoting of the door if one end of the first stopper is pulled into the cut, and to enable the door to be able to pivot if the one end of the first stopper is pulled out from the cut.

The second stopper may be configured to move in a direction that crosses a sliding direction of the door, preventing the hinge body from moving backward, if the door slides out a certain distance forward from the storeroom.

The hinge assembly may further include a pusher configured to move back and forth along with the hinge body, and the pusher is configured to move the second stopper in a direction that crosses the sliding direction of the door to enable the hinge body to move backward, if the door that has slid out pivots in a direction to close the storeroom and then slides toward the storeroom.

The hinge assembly may further include a catcher configured to restrict a movement range of the first stopper, and if the first stopper moves a certain distance, the catcher is configured to catch one end of the first stopper to enable the other end of the first stopper to be pulled out from the cut.

If the pusher pushes the second stopper in a first direction, the second stopper may be configured to move a seco d direction that crosses the first direction.

The first stopper, the hinge body, and the door may be configured to move back and forth in a first direction, and the second stopper may be configured to move back and forth in a second direction that crosses the first direction.

The hinge assembly may include a first elastic member configured to accumulate elastic force or deliver the accumulated elastic force to the first stopper when the door is sliding, and a second elastic member configured to elastically bias the second stopper to move to the back of the hinge body.

The hinge assembly may further include an elastic member configured to accumulate elastic force or deliver the accumulated elastic force to the pusher when the pusher is sliding.

The storeroom may include a plurality of first inclines arranged on front edges of the storeroom and inclining toward the inside of the storeroom, and the door comprises a plurality of second inclines arranged on rear edges of the door and inclining to correspond to the plurality of first inclines.

The door may further include a gasket arranged to seal the gap between the plurality of first inclines and the plurality of second inclines, and the gasket is arranged not to be exposed to the outside of the door when the door is closed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code"

includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings; in which like reference numerals represent like parts.

DETAILED DESCRIPTION

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Figure 1:
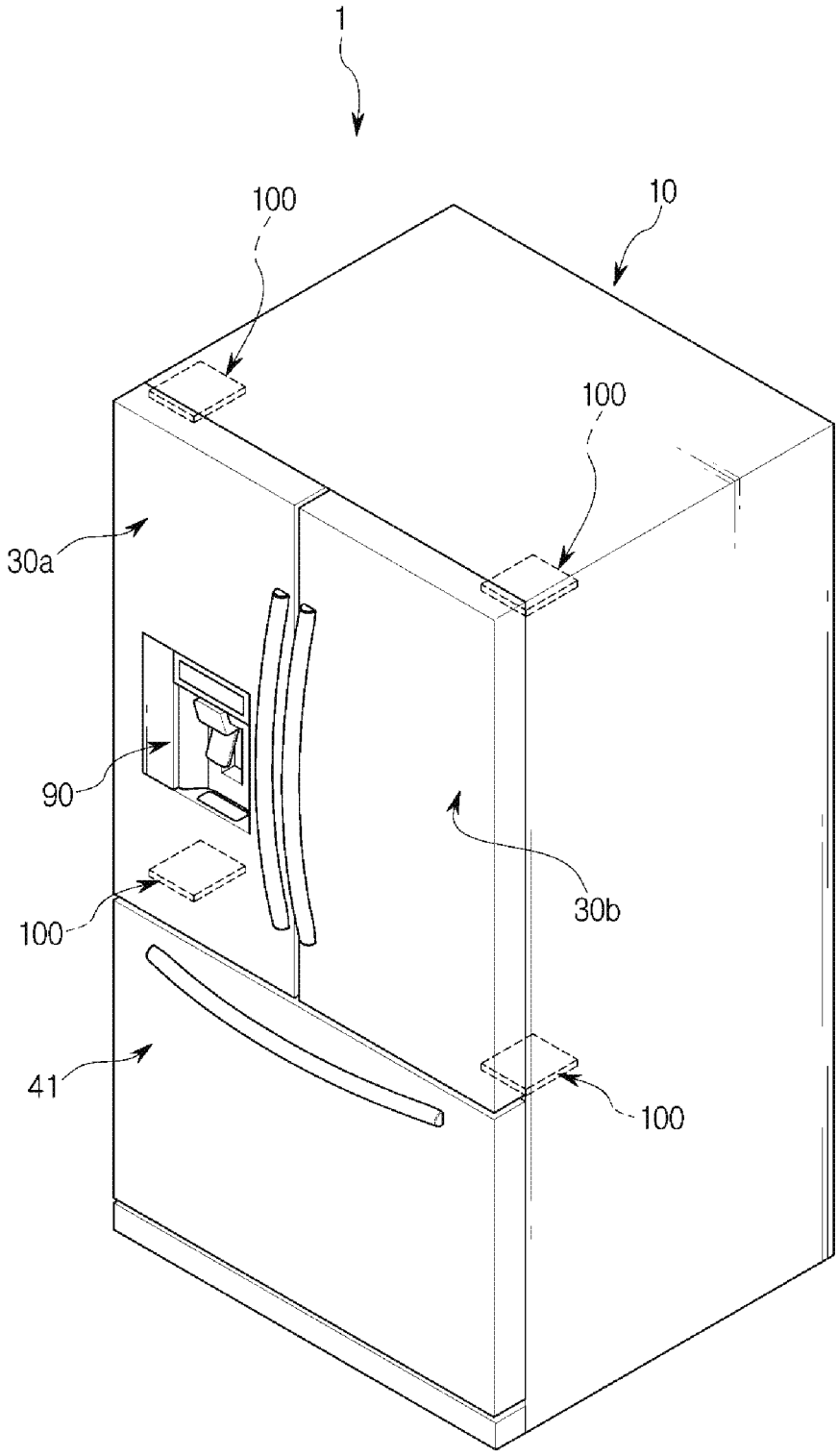
FIG. 1 illustrates an exterior view of a refrigerator with doors closed, according to various embodiment of the present disclosure.
Figure 2:
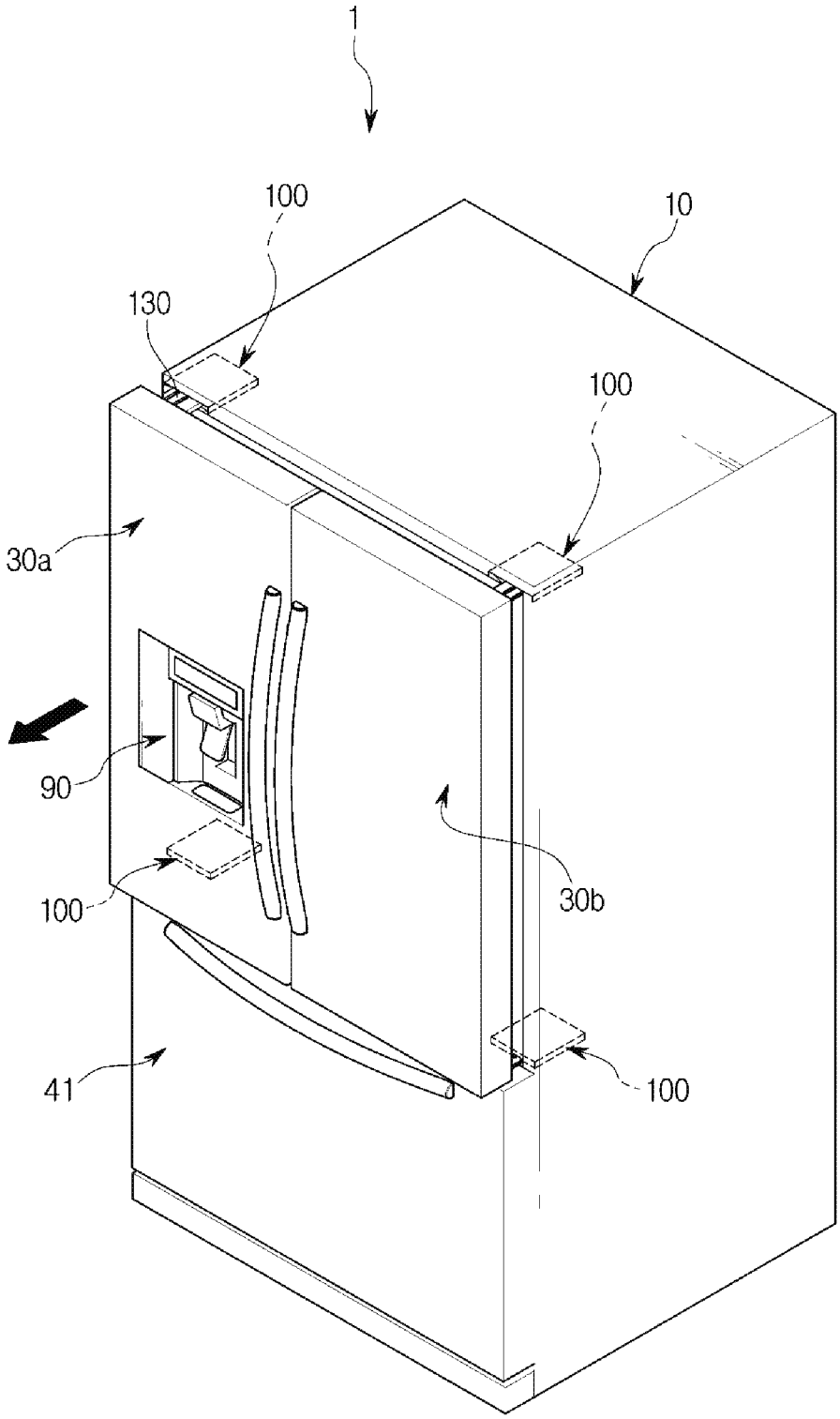
FIG. 2 illustrates an exterior view of the refrigerator of FIG. 1 with the doors drawn out forward according to various embodiment of the present disclosure.
Figure 3:
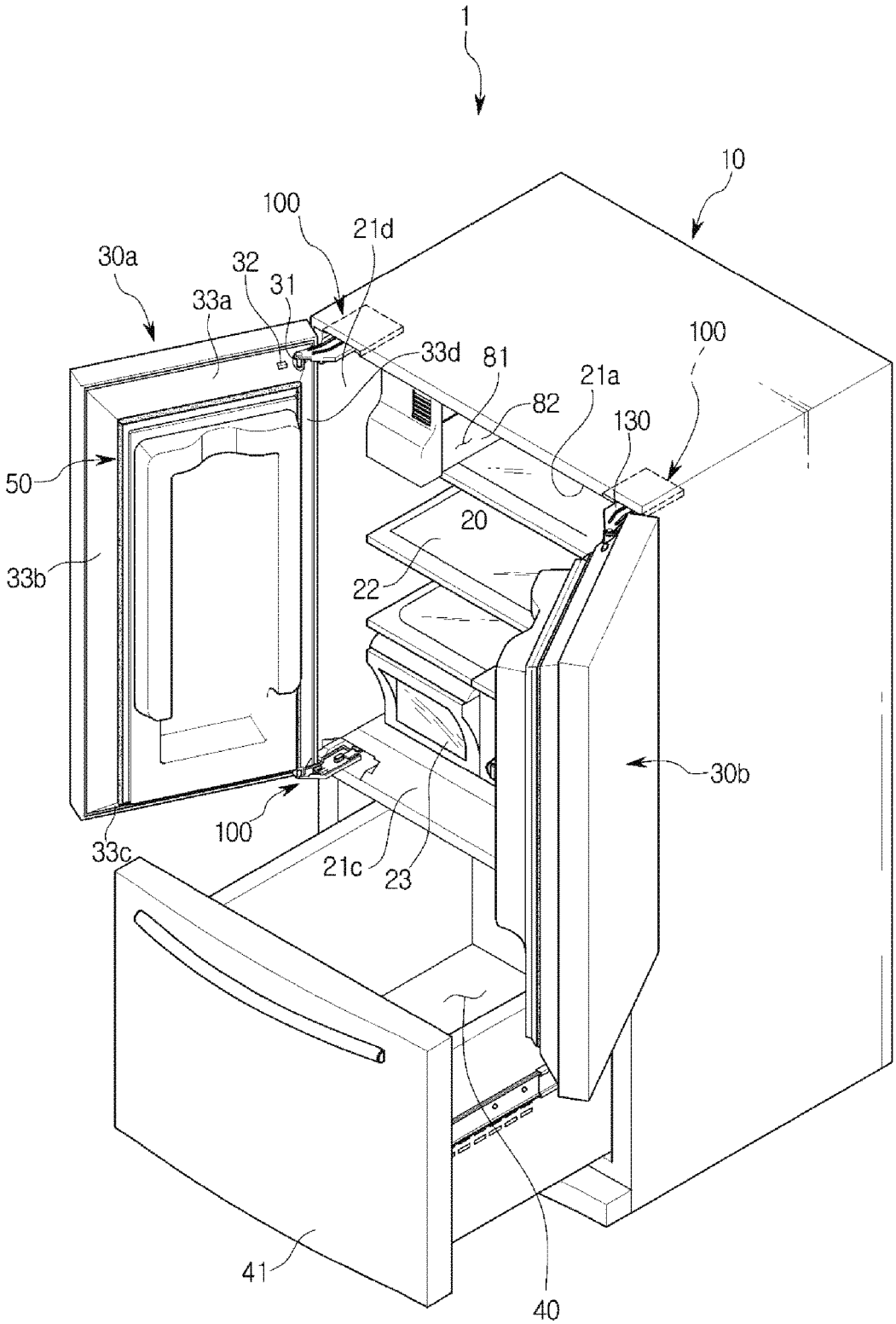
FIG. 3 illustrates an exterior view of the refrigerator of FIG. 1 with the doors opened according to various embodiment of the present disclosure.

FIG. 1 illustrates an exterior view of a refrigerator with doors closed, according to various embodiment of the present disclosure, FIG. 2 illustrates an exterior view of the refrigerator of FIG. 1 with the doors drawn out forward according to various embodiment of the present disclosure, and FIG. 3 illustrates an exterior view of the refrigerator of FIG. 1 with the doors opened according to various embodiment of the present disclosure.

A refrigerator 1 is a device capable of storing items at low temperatures. Specifically, the refrigerator 1 is a device able to keep the temperature of the storeroom below a level that the user wants by repeating vaporization and compression of a refrigerant so as to keep items at low temperatures.

As for the exterior of the refrigerator 1, the refrigerator 1 includes a main body 10, storerooms 20, 40 formed inside the main body 10, and a cooling device (not shown) for supplying cold air to the storerooms 20, 40, as shown in FIGS. 1 to 3. The cooling device may include an evaporator, a compressor, a condenser, and an expansion valve for performing cyclic evaporation and compression of a refrigerant.

The main body 10 may include an inner casing that forms the storerooms 20, 40, an outer casing combined with the outside of the inner casing to form the exterior of the refrigerator, and an insulation (not shown) placed between the inner casing and the outer casing to insulate the storerooms 20,40.

For example, the storerooms 20 may be divided by a middle partition wall 11 into an upper refrigerating storeroom 20 and a lower freezing storeroom 40. The form of dividing the storerooms 20, 40 is not limited to such horizontal division as shown in FIG. 2, but may have the form of vertical division or other various forms of division.

The refrigerating storeroom 20 may be kept at about 3° C. above zero to refrigerate groceries, and the freezing storeroom 40 may be kept at about 18.5° C. below zero to freeze groceries. Shelves 22 for groceries to be put thereon, and at least one container 23 for keeping groceries airtight may be arranged in the refrigerating storeroom 20.

The refrigerating storeroom 20 and the freezing storeroom 40 may each have an open front to take out groceries. The open front of the refrigerating storeroom 20 may be opened or closed by a pair of doors 30*a*, 30*b* (door 30) combined with the main body 10 through hinge assemblies 100, and the open front of the freezing storeroom 40 may be opened or closed by a sliding door 41 that is able to slide into or out of the main body 10.

On the border portions of the rear side of the doors 30 of the refrigerating storeroom 20, there may be a gasket 50 for preventing cold air of the refrigerating storeroom 20 from leaking out by making the gap between the doors 30 and the main body 10 airtight while the doors 30 of the refrigerating storeroom 20 are closed.

On the top corner of the refrigerating storeroom 20, there may also be an ice maker room 81 partitioned by an ice maker wall 82 from the refrigerating storeroom 20 for making ice.

One of the doors 30A, 30B, e.g., the door 30A of the refrigerating storeroom 20, may be equipped with a dispenser 90 for the user to take out water or ice without opening the door 21. Although the dispenser 90 is shown to be positioned on the front of the refrigerator 1 as shown in FIG. 1, the dispenser 90 may be placed at anywhere that may provide various visual information.

As shown in FIGS. 1 to 3, the doors 30 of the refrigerator 1 may be configured to slide and pivot, according to an embodiment of the present disclosure. Specifically, the doors 30 may open the refrigerating room (hereinafter, referred to as a storeroom) 20 by sliding out forward from the main body 10 and then pivoting in a direction to open the storeroom 20. On the contrary, the doors 30 may close the storeroom 20 by pivoting in a direction to close the storeroom 20 and then sliding inward. While sliding, the doors 30 may be unable to pivot. Likewise, while pivoting, the doors 30 may be unable to slide. This will be described in more detail later.

According to an embodiment of the present disclosure, a plurality of first inclines 21*a*, 21*b*, 21*c*, 21*d* (21*d* are hidden in the drawings) may be formed on the front edge of the storeroom 20. Furthermore, there may be a plurality of second inclines 33*a*, 33*b*, 33*c*, 33*d* formed on the rear edge of the doors 30. The gasket 50 may be arranged on the plurality of second inclines 33*a*, 33*b*, 33*c*, 33*d* to make the storeroom 20 airtight. The first inclines 21*a* to 21*d* and the second inclines 33*a* to 33*d* may be arranged to correspond to each other. For example, the corresponding pair of the first and second inclines 21*a* to 21*d* and 33*a* to 33*d* may be arranged at the same angle.

With this structure, the refrigerator 1 in accordance with the embodiment of the present disclosure may prevent the gasket 50 from being exposed to the outside of the main body 10 when the doors 30 are closed, as shown in FIG. 1. In conventional refrigerators, the gasket is typically exposed to the outside of the refrigerator, and the exposed gasket would be discolored or cracked from hardening in time, thereby deteriorating the exterior quality of the refrigerator. In the embodiment of the present disclosure, as described above, since the refrigerator 1 prevents the gasket 50 from being exposed to the outside of the main body 10, the exterior quality and aesthetic value of the refrigerator 1 may be improved. Moreover, the improvement of the exterior quality of the refrigerator 1 may lead to an increase in product competitiveness and in user's satisfaction with the product.

In the meantime, the front edges of the storeroom 20 and the rear edges of the doors 30 are not exclusively formed with inclines. For example, they may be implemented to have any form that may contribute to the structure of the doors 30 and the storeroom 20 with the gasket 50 unexposed to the outside. For example, the front portion of the storeroom 20 may be formed stepwise, and the rear portion of the doors 30 may also be formed stepwise to correspond to the stepwise front portion of the storeroom 20. That is, top, bottom, left and right sides of the storeroom 20 and the doors 30 may have a two-step structure. In this regard, the gasket 50 may be arranged in the stepped backside of the door, which may prevent the gasket 50 from being exposed to the outside of the main body 10.

Figure 4:
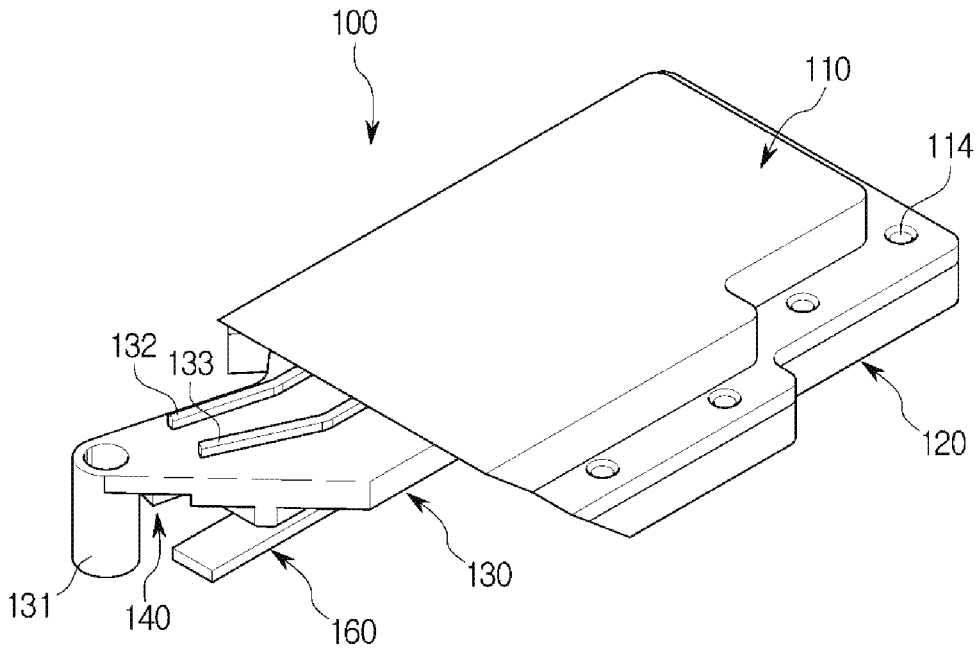
FIG. 4 illustrates a hinge assembly of a refrigerator, according to various embodiment of the present disclosure.
Figure 5:
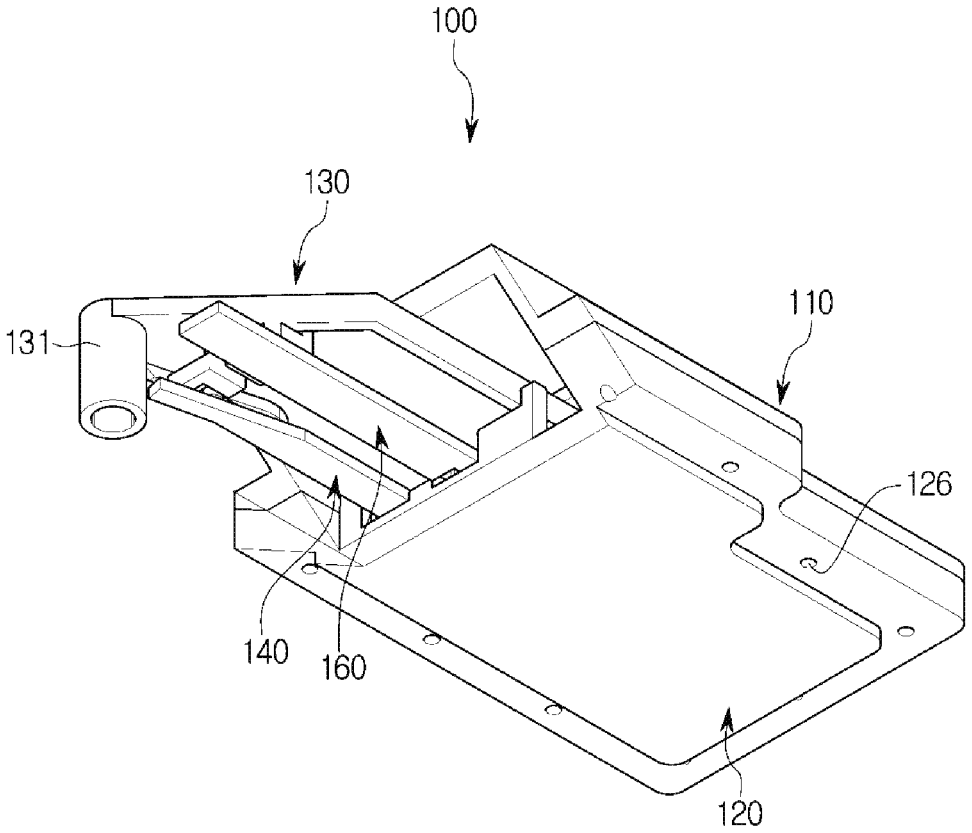
FIG. 5 illustrates a bottom perspective view of the hinge assembly shown in FIG. 4 according to various embodiment of the present disclosure.
Figure 6:
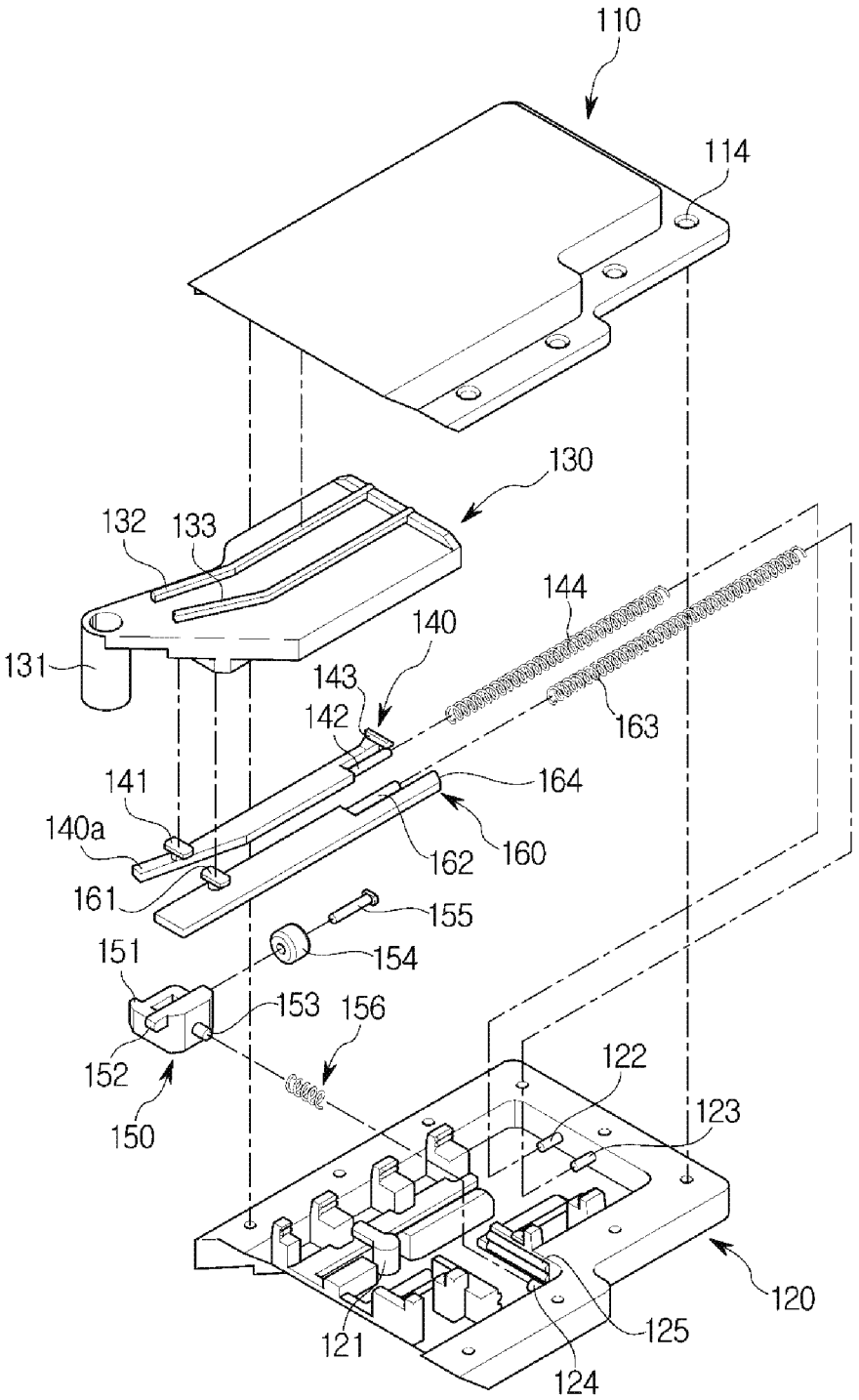
FIG. 6 illustrates an exploded view of the hinge assembly shown in FIG. 4 according to various embodiment of the present disclosure.
Figure 7:
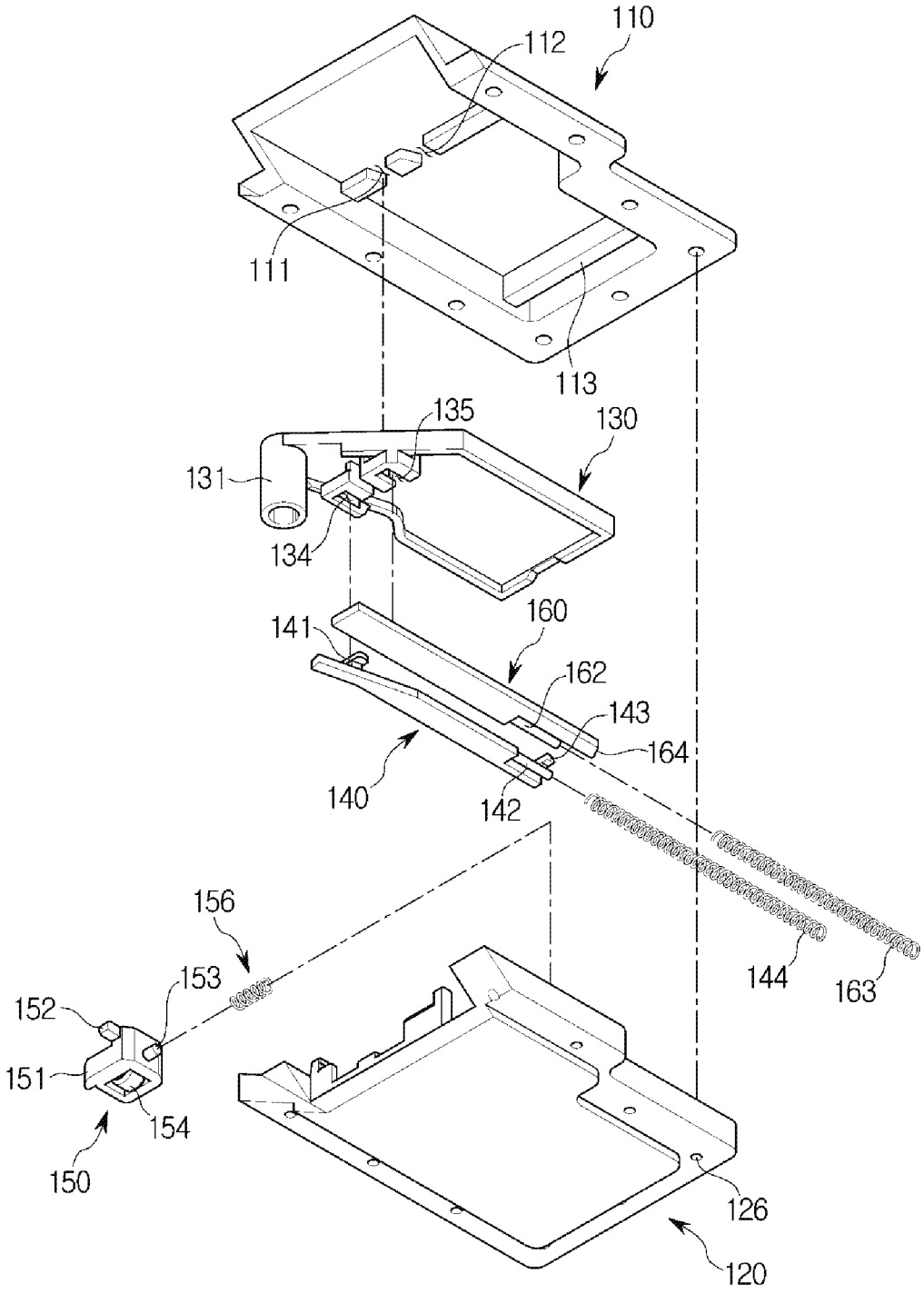
FIG. 7 illustrates the hinge assembly shown in FIG. 6 viewed from another point of view according to various embodiment of the present disclosure.

FIG. 4 illustrates a hinge assembly of a refrigerator, according to various embodiment of the present disclosure, and FIG. 5 illustrates a bottom perspective view of the hinge assembly shown in FIG. 4 according to various embodiment of the present disclosure. FIG. 6 illustrates an exploded view of the hinge assembly shown in FIG. 4 according to various embodiment of the present disclosure, and FIG. 7 illustrates the hinge assembly shown in FIG. 6 viewed from another point of view according to various embodiment of the present disclosure.

The hinge assembly 100 in accordance with an embodiment of the present disclosure will now be described in detail.

In the following description, the term 'first direction' may refer to the front-back direction with respect to the main body 10. The term 'second direction' may refer to a direction that crosses the first direction. For example, the second direction may refer to the left-right direction with respect to the main body 10.

The hinge assembly 100 may be configured to support the door 30 to be able to slide and pivot. The hinge assembly 100 may be arranged on the inner side of the main body 10. Accordingly, the hinge assembly 100 may not be exposed to the outside of the refrigerator 1. This may improve the exterior quality of the refrigerator 1 of the present disclosure.

The hinge assembly 100 may be configured to prevent the door 30 from pivoting while the door 30 is sliding. The hinge assembly 100 may be configured to prevent the door 30 from sliding while the door 30 is pivoting.

The hinge assembly 100 may include a top cover 110, a bottom cover 120, a hinge body 130, a first stopper 140, a second stopper 150, and a pusher 160.

The top cover 110 and the bottom cover 120 may be formed to be combined together. The top cover 110 may include a plurality of fastening holes 114 formed along its border, and the bottom cover 120 may also include a plurality of fastening holes 126 formed along its border. The fastening holes 114 of the top cover 110 and the fastening holes 126 of the bottom cover 120 are arranged at corresponding positions to each other, to combine the top cover 110 and the bottom cover 120 through fastening members (not shown).

The top cover 110 may include a first guide recess 111 and a second guide recess 112 formed on the bottom side. A first guide protrusion 132 formed on the hinge body 130 may be combined with the first guide recess 111 to be able to slide. A second guide protrusion 133 formed on the hinge body 130 may be combined with the second guide recess 112 to be able to slide.

The top cover 110 may include a rib 113 formed to restrict movement of the hinge body 130. The rib 113 may be formed on the bottom side of the top cover 110. The rib 113 may be further configured to come into contact with the back side of the hinge body 130 when the door 30 slides in, thereby preventing the hinge body 130 from further sliding in.

The bottom cover 120 may include a catcher 121. The catcher 121 may be arranged to restrict a forward movement of the first stopper 140. This will be described later.

The bottom cover 120 may include a first elastic member combiner 122, a second elastic member combiner 124, and a third elastic member combiner 123. The first elastic member combiner 122 may be combined with an end of a first elastic member 144. The second elastic member combiner 124 and the third elastic member combiner 123 may be combined with one ends of a second elastic member 156 and a third elastic member 163, respectively.

The bottom cover 120 may include a support wall 125 to support a side of the second stopper 150. The support wall 125 may prevent the second stopper 150 from moving in the first direction by contacting and supporting the second stopper 150. This will be described in more detail later.

The hinge body 130 may be arranged between the top cover 110 and the bottom cover 120. The hinge body 130 may be pivotally combined with the door 30. The hinge body 130 may be configured to be able to slide. The hinge body 130 may be configured to be able to move back and forth in the front-back direction.

The hinge body 130 may include a door combiner 131 configured to be pivotally combined with the door 30. The door combiner 131 may be pivotally combined with a hinge combiner 31 of the door 30. The door combiner 131 may be a pivot shaft of the door 30. Accordingly, the door 30 may pivot on the door combiner 131.

The hinge body 130 may include the first guide protrusion 132 and the second guide protrusion 133, which are formed on the top side of the hinge body 130. The first and second guide protrusions 132 and 133 may be slidably combined with the first and second guide recesses 111 and 112 on the top cover 110, respectively. The first and second guide protrusions 132 and 133 may be combined with the first and second guide recesses 111 and 112, respectively, to guide movement of the hinge body 130.

The hinge body 130 may include a first stopper fitting recess 134 and a pusher fitting recess 135 formed on the bottom side of the hinge body 130.

The first stopper 140 may be combined with the first stopper fitting recess 134 by fitting. Specifically, a combining protrusion 141 formed on the top side of the first stopper 140 may be slidably combined with the first stopper fitting recess 134. Similarly, the pusher 160 may be combined with the pusher fitting recess 135 by fitting, and a combining protrusion 161 formed on the top side of the pusher 160 may be slidably combined with the pusher fitting recess 135.

The first stopper 140 may be configured to prevent the door 30 from pivoting while the door 30 is slidable.

The first stopper 140 may include the combining protrusion 141 formed on the top side, an elastic member combiner 142 configured to be combined with the first elastic member 144, and a catching protrusion 143 configured to be caught in the catcher 121 on the bottom cover 120.

As described above, the combining protrusion 141 of the first stopper 140 may be combined with a first stopper fitting recess 134 on the hinge body 130. The first stopper 140 may be configured to move against the hinge body 130 even after combined with the hinge body 130. For example, the combining protrusion 141 may be configured to move back and forth in the first direction within the first stopper fitting recess 134.

The first elastic member 144 may be combined with the elastic member combiner 142 of the first stopper 140. One end of the first elastic member 144 may be supported by the first elastic member combiner 122 formed on the bottom cover 120 and the other end of the first elastic member 144 may be supported by the elastic member combiner 142 of the first stopper 140. This may enable the first elastic member 144 to provide elastic force to the first stopper 140.

The catching protrusion 143 may be configured to restrict the distance of forward movement of the first stopper 140. When the first stopper 140 moves a certain distance forward, the catching protrusion 143 and the catcher 121 are caught together, preventing the first stopper 140 from moving forward any further.

The second stopper 150 may include an incline protrusion 151, a support protrusion 152, and an elastic member combiner 153.

The incline protrusion 151 may include a third incline 151*a*. The third incline 151*a* may be formed to correspond to a fourth incline 164 formed in the pusher 160. With the third and fourth inclines 151*a* and 164, the pusher 160 moving in the first direction may move the second stopper 150 in the second direction that crosses the first direction.

The support protrusion 152 may be formed to support the rear side of the hinge body 130. With the support protrusion 152 supporting the rear side of the hinge body 130, sliding of the door 30 and the hinge body 130 may be prevented while the door 30 is able to pivot. At this time, the second stopper 150 may be supported by the support wall 125 of the bottom cover 120.

The second elastic member 156 may be combined with the elastic member combiner 153 of the second stopper 150. One end of the second elastic member 156 may be supported by the second elastic member combiner 124 formed on the bottom cover 120 and the other end of the second elastic member 156 may be supported by the elastic member combiner 153 of the second stopper 150. This may enable the second elastic member 156 to provide elastic force to the second stopper 150.

The second stopper 150 may further include a roller 154 and a shaft 155 rotationally supporting the roller 154.

The roller 154 may be configured to assist in the movement of the second stopper 150. The roller 154 may reduce the friction occurring when the second stopper 150 moves, enabling the second stopper 150 to stably move back and forth in the second direction.

The pusher 160 may include the combining protrusion 161 formed on the top side, and an elastic member combiner 162.

The pusher 160 may be combined with the hinge body 130 through the combining protrusion 161. Similar to the first stopper 140, the pusher 160 may be formed to be movable against the hinge body 130 even after combined with the hinge body 130. Specifically, the pusher 160 may be configured to be able to move back and forth within the pusher fitting recess 135.

Figure 8:
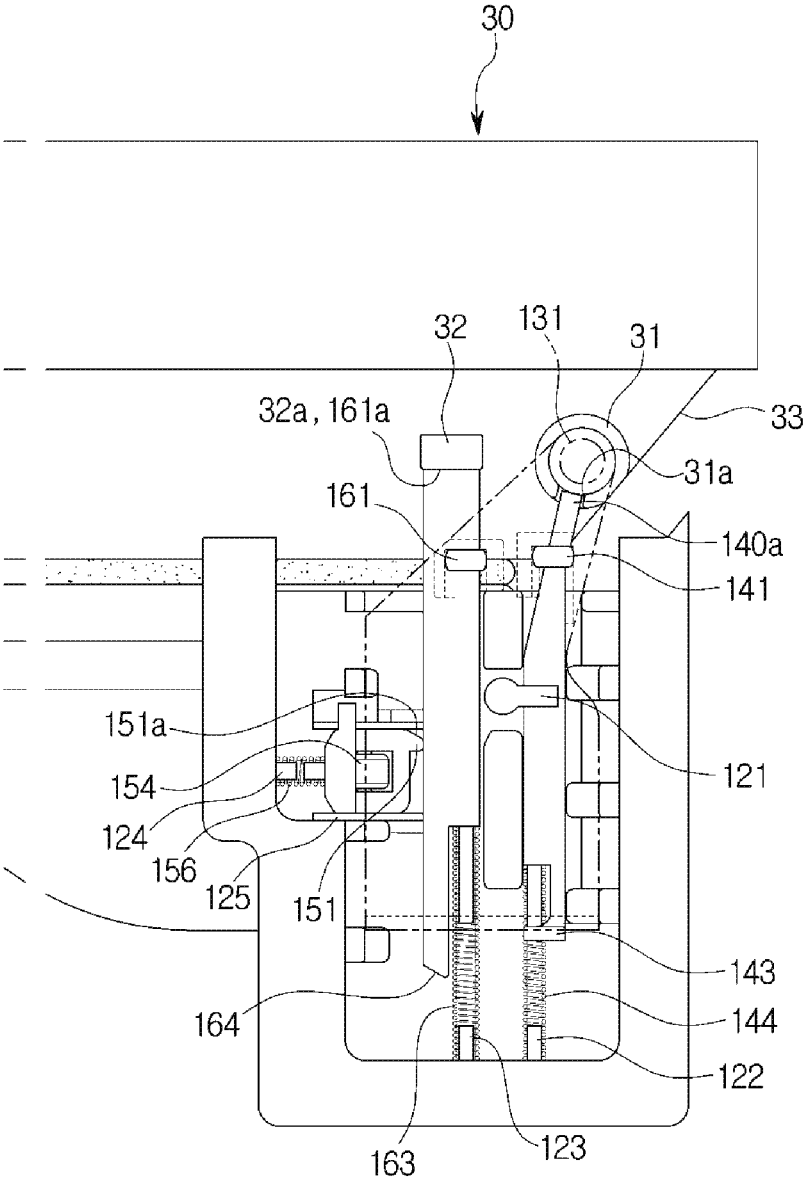
FIGS. 8 to 10 illustrate a door-opening operation in a refrigerator, according to various embodiments of the present disclosure.
Figure 9:
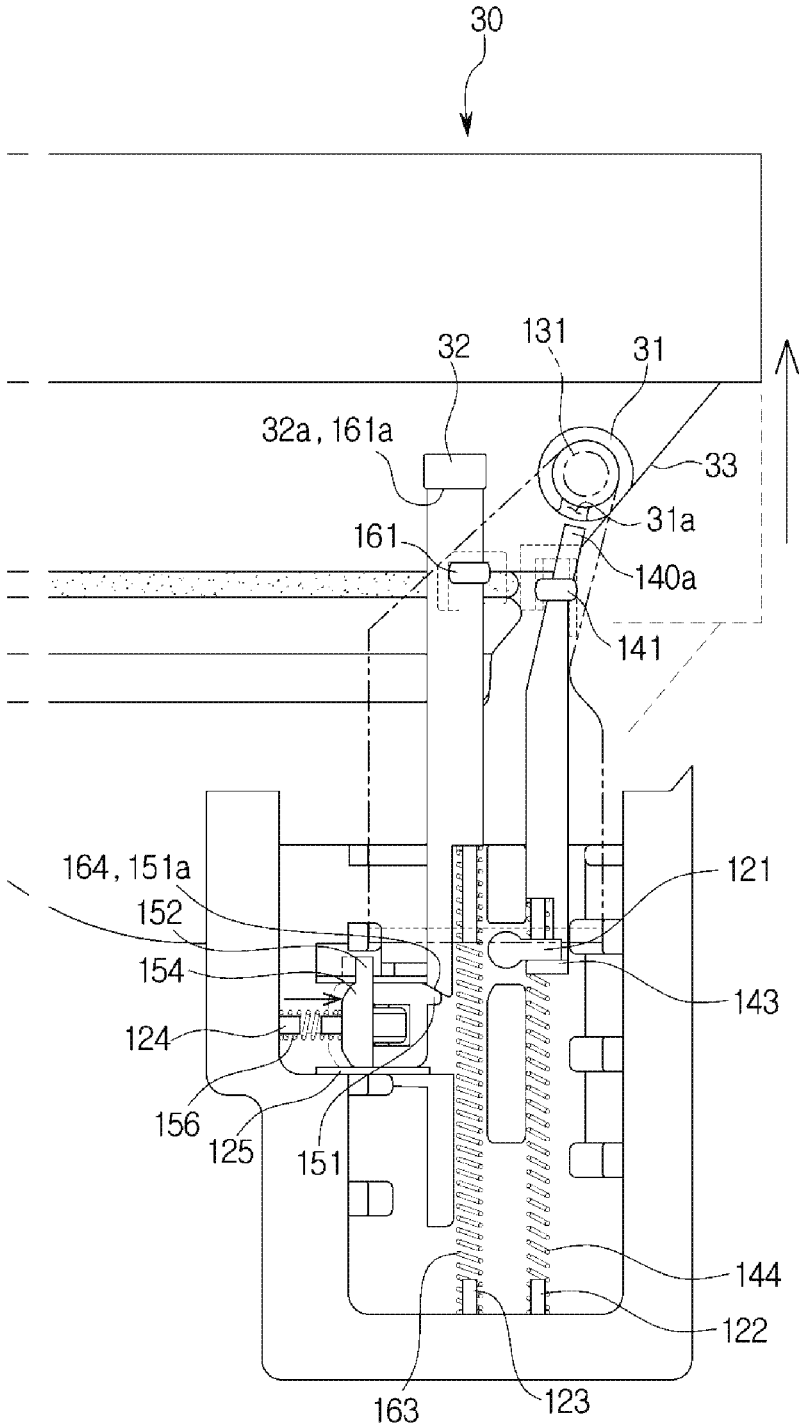
Figure 10:
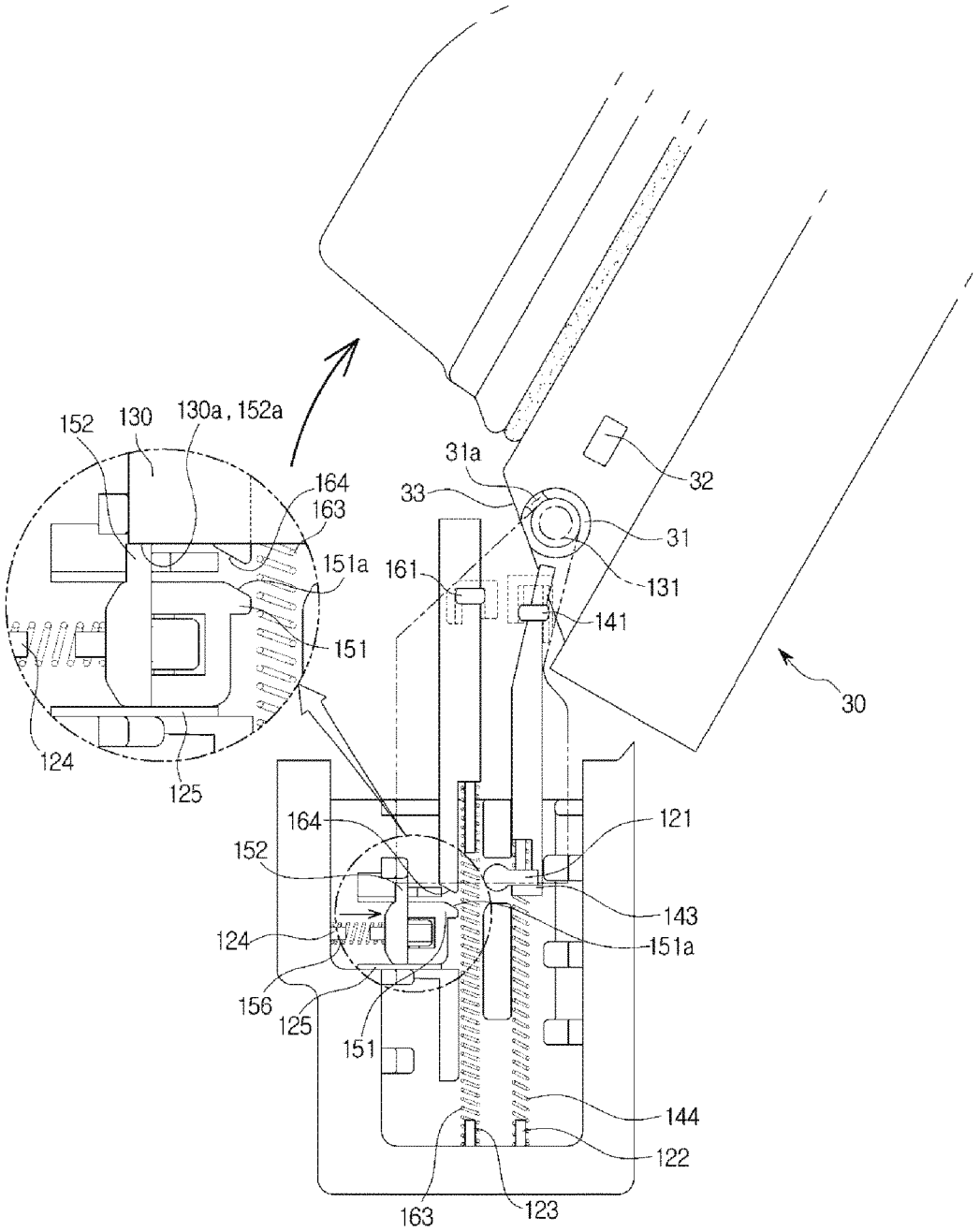
Figure 11:
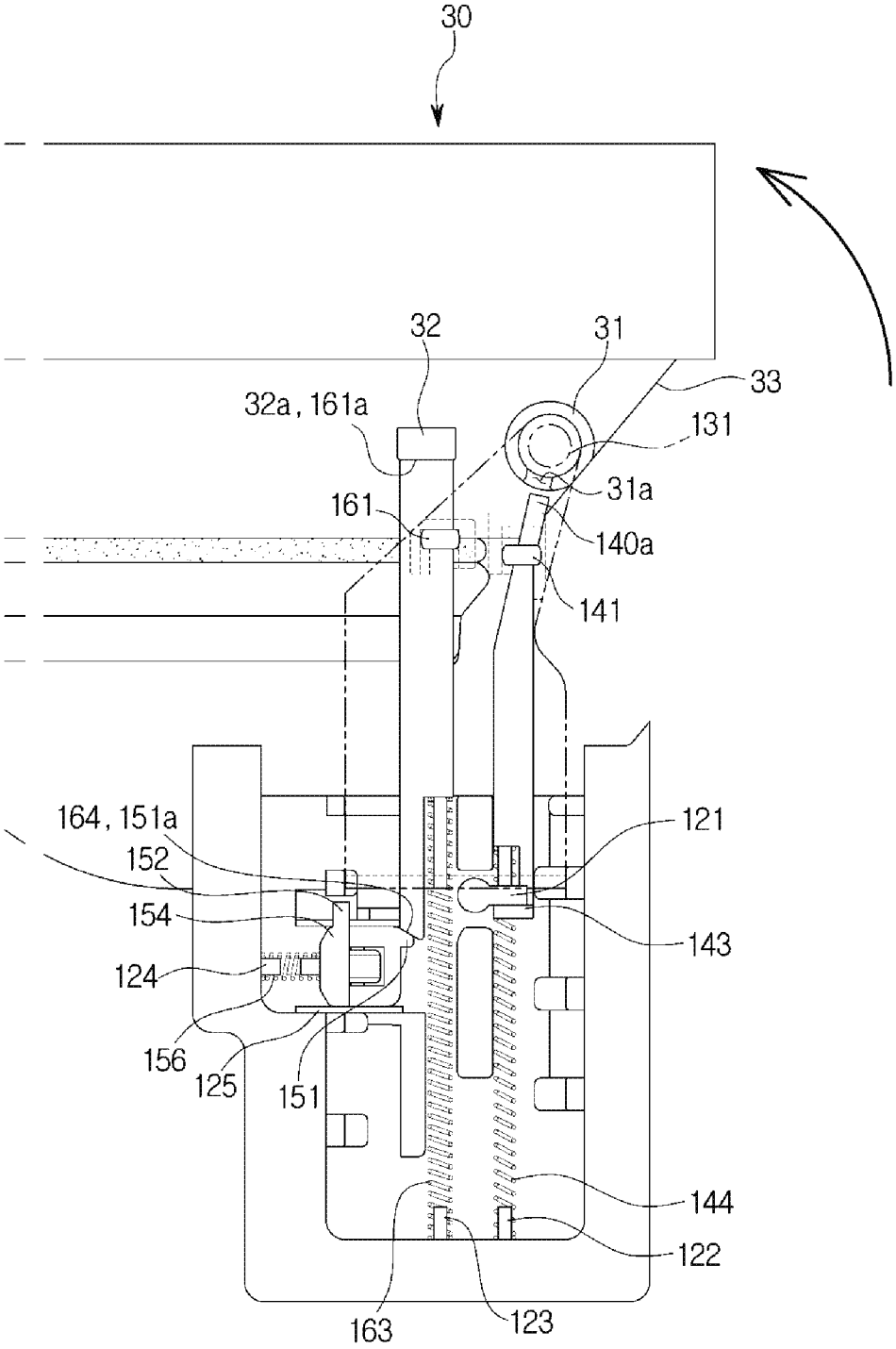
FIGS. 11 and 12 illustrate a door-closing operation in a refrigerator, according to various embodiment of the present disclosure.
Figure 12:
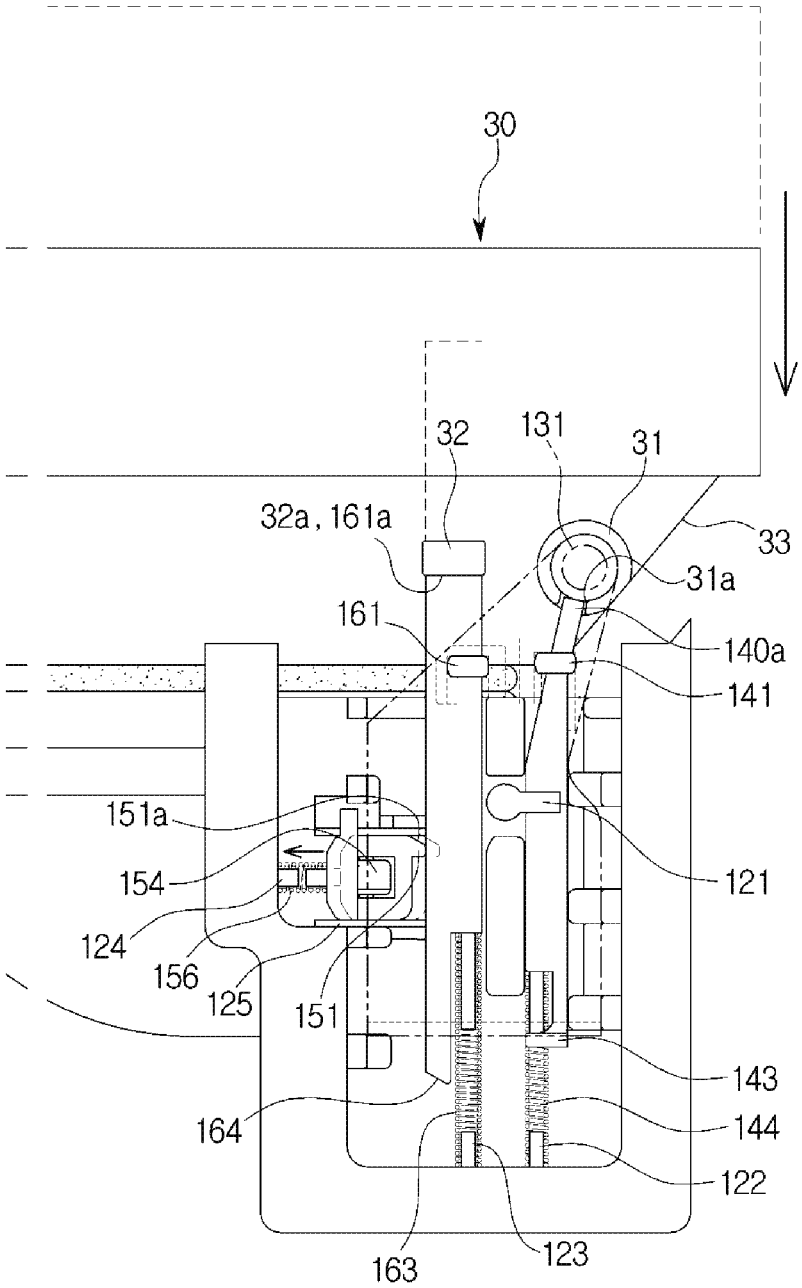

FIGS. 8 to 10 illustrate a door-opening operation in a refrigerator, according to various embodiment of the present disclosure, and FIGS. 11 and 12 illustrate a door-closing operation in a refrigerator, according to various embodiment of the present disclosure.

Operations of the first stopper, the second stopper, and the pusher during door opening or closing operation will now be described in detail.

For convenience of explanation, the hinge body 130 is shown in two point chain lines in FIGS. 8 to 12.

The door 30 may include the hinge combiner 31 configured to be pivotally combined with the hinge body 130, and a buffer 32 provided to come into contact with the pusher 160.

The hinge combiner 31 may include a cut 31*a* formed by cutting a portion of the hinge combiner 31. An end 140*a* of the first stopper 140 may be pulled into or pulled out from the cut 31*a*.

The buffer 32 may be configured to selectively come into contact with the pusher 160 depending on pivoting of the door 30. The buffer 32 may be formed of an elastic material to absorb shocks applied to the door 30 and the pusher 160 when contacting the pusher 160. For example, the buffer 32 may include a rubber material. The buffer 32 is not, however, limited thereto, but may also be formed of the same material as the remaining part of the door 30.

As shown in FIG. 8, when the door 30 is closed, the one end 140*a* of the first stopper 140 may be pulled into the cut 31*a*. In this case, the first stopper 140 may prevent the door 30 from pivoting. This is because the one end 140*a* of the first stopper 140 pulled into the cut 31*a* interrupts pivoting of the door 30.

When the door 30 is closed, the incline protrusion 151 of the second stopper 150 may come into contact with the flank of the pusher 160. At this time, elastic force may be accumulated in the second elastic member 156. In other words, the second elastic member 156 may be in the state of applying elastic force to the second stopper 150 to move in the second direction.

The pusher 160 may be in contact with the buffer 32 of the door 30.

As shown in FIG. 9, the door 30 may be pulled out forward from the storeroom 20 (see FIG. 3) by sliding.

While FIG. 9 shows that the one end 140*a* of the first stopper 140 is pulled out from the cut 31*a*, the one end 140*a* of the first stopper 140 remains inserted to the cut 31*a* when the door 30 is sliding, as shown in FIG. 8. Accordingly, while the door 30 is sliding out, pivoting of the door 30 may be prevented.

As shown in FIGS. 8 and 9, the hinge body 130, the first stopper 140, and the pusher 160 may be arranged to move back and forth together in the front-back direction. When the user pulls the door 30 forward, the hinge body 130 combined with the door 30 may slide forward along with the door 30. Furthermore, the first stopper 140 and the pusher 160 may move forward together with the hinge body 130 according to the elastic force of the first elastic member 144 and the third elastic member 163, respectively.

The first stopper 140 may be caught in the catcher 121 while moving forward according to the elastic force of the first elastic member 144. Specifically, the catching protrusion 143 of the first stopper 140 is caught in the catcher 121, restricting forward movement of the first stopper 140. Accordingly, further movement of the first stopper 140 is stopped. Since the combining protrusion 141 of the first stopper 140 is able to slide within the first stopper fitting recess 134 of the hinge body 130, the hinge body 130 and the pusher 160 is pulled out forward regardless of the first stopper 140.

As the first stopper 140 is caught in the catcher 121, the first stopper 140 may be pulled out from the cut 31*a*. Once the first stopper 140 is pulled out from the cut 31*a*, the pivoting operation of the door 30 is no longer restricted. Accordingly, the door 30 is able to pivot, and as shown in FIG. 10, the storeroom 20 may be opened by pivoting the door 30.

When the pusher 160 is pulled out forward by the elastic force of the third elastic member 163, the second stopper 150 may be able to move laterally. Specifically, when the pusher 160 moves in the first direction, the second stopper 150 moves in the second direction that crosses the first direction. The second stopper 150 may move in the second direction according to the accumulated elastic force of the second elastic member 156. When the second stopper 150 moves in the second direction, the incline protrusion 151 comes into contact with the pusher 160. Specifically, the third incline 151*a* of the incline protrusion 151 and the fourth incline 164 of the pusher 160 may come into contact with each other. In this case, due to the third and fourth inclines 151*a* and 164, the force by which the second stopper 150 is to move in the second direction may assist the pusher 160 to move in the first direction.

As shown in FIG. 10, the door 30 may open the storeroom 20 by pivoting. That is, the door 30 is able to pivot. At this time, slide-in of the door 30 may be prevented. Specifically, if the user attempts to pull in the door 30 backward while the door 30 is open, the support protrusion 152 of the second stopper 150 contacts and supports the hinge body 130 to restrict slide-in of the door 30 and the hinge body 130.

As shown in an enlarged view of FIG. 10, a side 152*a*, of the support protrusion 152 and the rear side 130*a* of the hinge body 130 may come into contact with each other. The second stopper 150 may come into contact with the support wall 125 of the bottom cover 120. Accordingly, the support protrusion 152 may prevent the hinge body 130 from moving backward. Since the door 30 is combined with the hinge body 130, pull-in operation of the door 30 may be prevented as well. Therefore, according to the present disclosure, sliding operation may be prevented while the door 30 is able to pivot. This is to prevent the door 30 from sliding in the pivoted state to avoid colliding with nearby furniture.

The number of users who choose a built-in refrigerator for harmonization with nearby furniture increases these days. As for the built-in refrigerator, it is common to arrange the nearby furniture to be very close to the flank of the refrigerator. In this case, if the door of the refrigerator is able to pivot at once without being pulled out forward, the door might collide with the nearby furniture. When the door of the refrigerator collides with the nearby furniture, the door and the peripheral furniture may possibly have scratches. In accordance with the present disclosure, since the door 30 of the refrigerator 1 is configured to pivot after sliding out forward, the door 30 may not collide with the nearby furniture even if the furniture is located very close to the flank of the refrigerator 1.

Meanwhile, even if the door is configured to be able to slide and pivot, the door may collide with the nearby furniture if the door is able to pivot while sliding. This problem may be avoided according to the present disclosure, because pivoting operation of the door is prevented while the door is sling and further, sliding operation of the door in the pivoted state and sliding operation of the door during the pivoting operation are prevented.

FIGS. 11 and 12 illustrate door-closing operations in a refrigerator, according to various embodiment of the present disclosure.

Operation of closing the door of the refrigerator will now be described in detail.

As described above, when the storeroom 20 is opened by pivoting the door 30 or while the door 30 is pivoting, slide-in of the door 30 may be prevented. To close the door 30, the door 30 may first pivot in a direction to close the storeroom 20.

When the door 30 pivots in the direction to close the storeroom 20, the buffer 32 and the front side 161*a* of the pusher 160 may come into contact. If the door 30 is pushed backward while the front side 161*a* of the pusher 160 and the buffer 32 are in contact to each other, the fourth incline 164 of the pusher 160 and the third incline 151*a* of the second stopper 150 come into contact.

The third and fourth inclines 151*a* and 164 are formed to deliver a force to the respective directions that cross each other. Accordingly, if the pusher 160 is moved in the first direction, the second stopper 150 may be moved in the second direction that crosses the first direction.

As shown in FIG. 12, if the user pushes the door 30 backward from the main body 10, the hinge body 130 combined with the door 30 is moved backward, and along with the hinge body 130, the first stopper 140 and the pusher 160 are moved backward.

As the first stopper 140 moves backward, the first elastic member 144 may accumulate elastic force. Similarly, as the pusher 160 moves backward, the third elastic member 163 may accumulate elastic force.

As described above, while the pusher 160 moves backward, the fourth incline 164 and the third incline 151*a* come into contact. When the fourth incline 164 applies force to the third incline 151*a* in the first direction, the inclination of the third incline 151*a* enables the second stopper 150 to be forced to move in the second direction that crosses the first direction. That is, the second stopper 150 moves back to the original position at which the door 30 is closed.

When the door 30 moves backward, the one end 140*a* of the first stopper 140 may be pulled into the cut 31*a*. As the one end 140*a* of the first stopper 140 is pulled into the cut 31*a*, pivoting operation of the door 30 may be prevented.

In the meantime, the first elastic member 144 and the third elastic member 163 may accumulate elastic force and simultaneously, serve as dampers when the door 30 slides in. Specifically, if the user slams the door shut, the first elastic member 144 and the third elastic member 163 perform a damping function to cushion the impact on the door 30.

According to embodiments of the present disclosure, a refrigerator may include a hinge assembly that enables a door to selectively slide and pivot.

According to embodiments of the present disclosure, a refrigerator may include a door configured to pivot after being drawn out forward, thereby avoiding a collision with furniture located on a side to the refrigerator.

According to embodiments of the present disclosure, a refrigerator may have a gasket that is not exposed to the outside, thereby improving aesthetic values.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a main body;

a storeroom arranged inside the main body;

a door movable to open and close the storeroom and comprising a hinge combiner that includes a cut; and a hinge assembly configured to allow the door to slide and pivot, the hinge assembly comprising:

a hinge body coupled to the door and configured to allow the door to slide toward or away from the main body, a first stopper configured to:

prevent pivoting of the door if a first end of the first stopper is pulled into the cut allowing the door to slide; and enable the door to be able to pivot if the first end of the first stopper is pulled out from the cut;

a second stopper configured to prevent sliding of the door if the door is able to pivot; and a catcher configured to restrict a movement range of the first stopper.

2. The refrigerator of claim 1, wherein the door is configured to open the storeroom by sliding out forward from the storeroom and then pivoting in a direction to open the storeroom, and to close the storeroom by pivoting in a direction to close the storeroom and then sliding into the storeroom.

3. The refrigerator of claim 1, wherein:

the hinge combiner is configured to be combined with the hinge body, and the cut is formed by cutting a portion of the hinge combiner.

4. The refrigerator of claim 3, wherein the catcher is configured to restrict the movement range of the first stopper if the first stopper moves a certain distance by catching a second end of the first stopper to enable the first end of the first stopper to be pulled out from the cut.

5. The refrigerator of claim 1, wherein the second stopper is configured to move in a direction that crosses a sliding direction of the door, preventing the hinge body from moving backward, if the door slides out a certain distance forward from the storeroom.

6. The refrigerator of claim 5, wherein the hinge assembly further comprises a pusher configured to move back and forth along with the hinge body, and the pusher is configured to move the second stopper in a direction that crosses the sliding direction of the door to enable the hinge body to move backward if the door that has slid out pivots in a direction to close the storeroom and then slides toward the storeroom.

7. The refrigerator of claim 6, wherein if the pusher pushes the second stopper in a first direction, the second stopper is configured to move in a second direction that crosses the first direction.

8. The refrigerator of claim 6, wherein the hinge assembly further comprises an elastic member configured to accumulate elastic force or deliver the accumulated elastic force to the pusher when the pusher is sliding.

9. The refrigerator of claim 1, wherein the first stopper, the hinge body, and the door are configured to move back and forth in a first direction, and the second stopper is configured to move back and forth in a second direction that crosses the first direction.

10. The refrigerator of claim 1, wherein the hinge assembly comprises:

a first elastic member configured to accumulate elastic force or deliver the accumulated elastic force to the first stopper when the door is sliding; and a second elastic member configured to elastically bias the second stopper to move to a back of the hinge body.

11. The refrigerator of claim 10, wherein the door further comprises a gasket arranged to seal a gap between a plurality of first inclines and a plurality of second inclines, and the gasket is arranged not to be exposed to the outside of the door when the door is closed.

12. The refrigerator of claim 1, wherein the storeroom comprises a plurality of first inclines arranged on front edges of the storeroom and inclining toward the inside of the storeroom, and the door comprises a plurality of second inclines arranged on rear edges of the door and inclining to correspond to the plurality of first inclines.

13. A refrigerator comprising:

a main body;

a storeroom arranged inside the main body;

a door movable to open and close the storeroom and comprising a cut; and a hinge assembly configured to allow the door to slide and pivot, the hinge assembly comprising:

a first stopper configured to:

prevent pivoting of the door if a first end of the first stopper is pulled into the cut allowing the door to slide, and enable pivoting of the door if the first end of the first stopper is pulled out from the cut, a second stopper configured to prevent sliding of the door if the door is able to pivot, and a catcher configured to restrict a movement range of the first stopper, wherein the door is configured to:

open the storeroom by sliding forward from the storeroom and then pivoting in a first direction, close the storeroom by pivoting in a second direction that is the opposite direction to the first direction and then sliding toward the storeroom, prevent the door from pivoting when the door is sliding, and prevent the door from sliding when the door is pivoting.

14. The refrigerator of claim 13, wherein the hinge assembly further comprises a hinge body pivotally combined with the door.

15. The refrigerator of claim 14, wherein the cut is formed for the first end of the first stopper to be pulled into or pulled out from the cut.

16. The refrigerator of claim 15, wherein the second stopper is configured to prevent sliding of the door by moving to a back location of the hinge body if at least a portion of the first stopper is pulled out from the cut.

17. The refrigerator of claim 14, wherein the catcher is configured to restrict the movement range of the first stopper if the first stopper moves a certain distance by catching a second end of the first stopper to restrict movement of the first stopper in a direction toward the door.

18. The refrigerator of claim 14, wherein the hinge assembly further comprises a pusher configured to move back and forth in the first direction, and wherein if the pusher pushes the second stopper in the first direction, the pusher is configured to enable the second stopper to move in the second direction that crosses the first direction.

19. A refrigerator comprising:

a main body;

a storeroom arranged inside the main body;

a door movable to open and close the storeroom and comprising a cut;

a gasket arranged to seal a gap between the door and the storeroom; and a hinge assembly configured to allow the door to slide and pivot, comprising:

a first stopper configured to:

prevent pivoting of the door if an end of the first stopper is pulled into the cut allowing the door to slide; and enable pivoting of the door if the end of the first stopper is pulled out from the cut;

a second stopper configured to prevent sliding of the door if the door is able to pivot, and a catcher configured to restrict a movement range of the first stopper, wherein the gasket is arranged not to be exposed to the outside of the door when the door is closed.

* * * * *